US011499424B2

(12) United States Patent
Shaker et al.

(10) Patent No.: US 11,499,424 B2
(45) Date of Patent: Nov. 15, 2022

(54) SYSTEMS AND METHODS TO DETERMINE THE PRODUCTIVITY INDEX OF INDIVIDUAL LATERALS UNDER COMMINGLED FLOW

(71) Applicant: Saudi Arabian Oil Company, Dhahran (SA)

(72) Inventors: Wisam Shaker, Dhahran (SA); Abdulhamid Alsousy, Dhahran (SA); Bandar Mutairi, Dhahran (SA); Majed Shammari, Dhahran (SA)

( * ) Notice: Subject to any disclaimer, the term of this patent is extended or adjusted under 35 U.S.C. 154(b) by 94 days.

(21) Appl. No.: 17/178,639

(22) Filed: Feb. 18, 2021

(65) Prior Publication Data

US 2022/0259972 A1 Aug. 18, 2022

(51) Int. Cl.
*E21B 49/08* (2006.01)
*E21B 47/06* (2012.01)
(Continued)

(52) U.S. Cl.
CPC ..... *E21B 49/087* (2013.01); *E21B 41/0035* (2013.01); *E21B 43/12* (2013.01); *E21B 47/06* (2013.01); *G08B 21/182* (2013.01)

(58) Field of Classification Search
CPC ..... E21B 47/06; E21B 49/08; E21B 49/00; E21B 49/0875; E21B 49/087
See application file for complete search history.

(56) References Cited

U.S. PATENT DOCUMENTS 10,402,516 B2 9/2019 Hamza et al.
10,508,521 B2 12/2019 Shammar et al.
(Continued)

FOREIGN PATENT DOCUMENTS

CN 104196527 A 12/2014
CN 109403961 A 3/2019
CN 110863814 A 3/2020

OTHER PUBLICATIONS

Al-Rbeawi, "Deep Insights to Transient Pressure Behavior and Stabilized Productivity Index of Multilateral Wells in laterally and Spatially Anisotropic Reservoirs", Journal of Natural Gas Science & Engineering, doi: 10.1016/j.ingse.2018.04.008, 2018.
(Continued)

*Primary Examiner* — Caroline N Butcher
(74) *Attorney, Agent, or Firm* — Dinsmore & Shohl LLP

(57) ABSTRACT

Systems and methods for determining the productivity indices for individual laterals of a completed multilateral well under commingled flow comprise a productivity index generator, zonal inflow control valves (ICVs), and a pressure downhole monitoring system (PDHMS). The completed multilateral well comprises a mother bore and a plurality of laterals extending from the mother bore in corresponding well zones of the mother bore. Each zonal ICV is configured to close for a shut-in period and open for an open period. The PDHMS is configured to generate real time pressure measurements for each well zone of the mother bore. The productivity index generator is communicatively coupled to the zonal ICVs and the PDHMS and is operable to determine a productivity index for individual laterals under commingled flow based on (i) the productivity index ratio of individual laterals under non-commingled flow and (ii) the global well productivity index under commingled flow.

20 Claims, 7 Drawing Sheets

(51) Int. Cl.

| | |
|---|---|
| ***E21B 43/12*** | (2006.01) |
| ***E21B 41/00*** | (2006.01) |
| ***G08B 21/18*** | (2006.01) |

(56) References Cited

U.S. PATENT DOCUMENTS

| | | | | |
|---|---|---|---|---|
| 10,697,283 | B2 | 6/2020 | AlQahtani et al. | |
| 2018/0347326 | A1* | 12/2018 | Shammari | E21B 44/005 |
| 2021/0148196 | A1* | 5/2021 | Bukhamseen | G05B 13/00 |

OTHER PUBLICATIONS

Chen et al., "A Comprehensive Model of Multilateral Well Deliverability", Society of Petroleum Engineers, SPE64751, 2000.

Raghavan et al., "An Assessment of the Productivity of Multilateral Completions", The Journal of Canadian Petroleum Technology, vol. 37, No. 10, pp. 58-67, Oct. 1998.

Yildiz et al., "Multilateral Pressure-Transient Response", Society of Petroleum Engineers, Petroleum Society of CIM65479, 2000.

Yildiz, "Multilateral Horizontal Well Productivity", Society of Petroleum Engineers, SPE94223, 2005.

Zinati et al., "Estimating the Specific Productivity Index in Horzontal Wells from Distributed-Pressure Measurements Using an Adjoint-Based Minimization Algorithm", Society of Petroleum Engineers, SPE135223, Sep. 2012.

Retnanto, et al., "Inflow Performance Relationships of Horizontal and Multibranched Wells in a Solution-Gas-Drive Reservoir", Society of Petroleum Engineers, SPE49054, 1998.

* cited by examiner

SYSTEMS AND METHODS TO DETERMINE THE PRODUCTIVITY INDEX OF INDIVIDUAL LATERALS UNDER COMMINGLED FLOW

TECHNICAL FIELD

Embodiments described herein generally relate to multilateral well completions and, more specifically, to systems and methods for determining a productivity index for a lateral of a multilateral well completion under commingled flow.

BACKGROUND

Multilateral wells may include a mother bore and laterals as well branches extending from the mother bore. A well completion of a multilateral well can equip the mother bore and laterals with sensors such as monitoring devices to measure flow properties as well as control valves to control production from the well. Multilateral well modeling and producing lateral performance prediction under commingled flow may be challenging due to aspects such as an interplay between the laterals, pressure drop behaviors, a lack of down hole flow rate metering, or a need for input dimensions specific to each lateral.

Accordingly, a need exists for alternative systems and methods to accurately determine respective productivity indices of individual producing laterals.

BRIEF SUMMARY

According to the subject matter of the present disclosure, a system for determining the productivity indices for individual laterals of a completed multilateral well under commingled flow comprises a productivity index generator, a plurality of zonal inflow control valves (ICVs), and a pressure downhole monitoring system (PDHMS). The completed multilateral well comprises a mother bore and a plurality of laterals extending from the mother bore in corresponding well zones of the mother bore. Each zonal ICV respectively controls commingled flow of an individual lateral of the plurality of laterals of the completed multilateral well. Each of the zonal ICV is configured to close for a shut-in period and open for an open period. The PDHMS is configured to generate real time pressure measurements for each well zone of the mother bore during the respective shut-in and open periods established by the zonal ICVs. The productivity index generator is communicatively coupled to the zonal ICVs and the PDHMS and is operable to conduct well testing of the individual laterals under non-commingled flow using the PDHMS to generate the real time pressure measurements for each well zone during the respective shut-in and open period for each individual lateral as controlled by the respective zonal ICV, determine a productivity index $P_{LN}$ for each individual lateral under non-commingled flow based on the real time pressure measurements from the well testing using the zonal ICVs and PDHMS, determine a productivity index ratio C of at least two individual laterals under non-commingled flow from the generated productivity indices $P_{LN}$, determine a global productivity index $P_G$ of the completed multilateral well under commingled flow based on the well testing using the zonal ICVs and PDHMS, determine a productivity index $P_{LC}$ for at least two of the individual laterals under commingled flow based on (i) the productivity index ratio C of at least two individual laterals under non-commingled flow and (ii) the global productivity index $P_G$ of the completed multilateral well under commingled flow.

In accordance with an embodiment of the present disclosure, a system for determining the productivity indices for individual laterals of a completed multilateral well under commingled flow, the system comprising a control station, a plurality of zonal inflow control valves (ICVs), and a pressure downhole monitoring system (PDHMS). The completed multilateral well comprises a mother bore and a plurality of laterals extending from the mother bore in corresponding well zones of the mother bore. Each zonal ICV respectively controls commingled flow of an individual lateral of the plurality of laterals of the completed multilateral well. Each zonal ICV is configured to close the flow for a shut-in period and open for an open period. The PDHMS is configured to generate real time pressure measurements for each well zone of the mother bore during the respective shut-in and open periods established by the zonal ICVs. The control station comprises a productivity index generator that is communicatively coupled to the zonal ICVs and the PDHMS and is operable to conduct well testing of the individual laterals under non-commingled flow using the PDHMS to generate the real time pressure measurements for each well zone during the respective shut-in and open period for each individual lateral as controlled by the respective zonal ICV, determine a productivity index $P_{LN}$ for each individual lateral under non-commingled flow based on the real time pressure measurements from the well testing using the zonal ICVs and PDHMS, determine a productivity index ratio C of at least two individual laterals under non-commingled flow from the generated productivity indices $P_{LN}$, determine a global productivity index $P_G$ of the completed multilateral well under commingled flow based on the well testing using the zonal ICVs and PDHMS, and determine a productivity index $P_{LC}$ for at least two of the individual laterals under commingled flow based on (i) the productivity index ratio C of at least two individual laterals under non-commingled flow and (ii) the global productivity index $P_G$ of the completed multilateral well under commingled flow. The control station is further operable to control the zonal ICVs to modify the flow of the individual laterals based on the productivity index $P_{LC}$ for the at least two of the individual laterals to optimize production.

In accordance with an embodiment of the present disclosure, a method for determining the productivity indices for individual laterals of a completed multilateral well under commingled flow, the completed multilateral well comprising a mother bore and a plurality of laterals extending from the mother bore in corresponding well zones of the mother bore, is disclosed. The method comprises conducting well testing of individual laterals of the plurality of laterals of the completed multilateral well under non-commingled flow using a pressure downhole monitoring system (PDHMS) to generate real time pressure measurements for each well zone during respective shut-in and open periods for each individual lateral as controlled by respective zonal inflow control valves (ICVs), wherein each zonal ICV respectively controls commingled flow of an individual lateral of the plurality of laterals of the completed multilateral well. The method may further comprise determining a productivity index $P_{LN}$ for each individual lateral under non-commingled flow based on the real time pressure measurements from the well testing using the zonal ICVs and PDHMS. The method may further comprise determining a productivity index ratio C of at least two individual laterals under non-commingled flow from the generated productivity indices $P_{LN}$. The method may further comprise determining a global productivity index $P_G$ of the completed multilateral well under commingled flow based on the well testing using the zonal ICVs and PDHMS. The method may further comprise determining a productivity index $P_{LC}$ for at least two of the individual laterals under commingled flow based on (i) the productivity index ratio C of at least two individual laterals under non-commingled flow and (ii) the global productivity index $P_G$ of the completed multilateral well under commingled flow.

Although the concepts of the present disclosure are described herein with primary reference to recovering hydrocarbons, it is contemplated that the concepts will enjoy applicability to recovery of other resources utilizing multilateral wells.

BRIEF DESCRIPTION OF THE SEVERAL VIEWS OF THE DRAWINGS

The following detailed description of specific embodiments of the present disclosure can be best understood when read in conjunction with the following drawings, where like structure is indicated with like reference numerals and in which.

DETAILED DESCRIPTION

Figure 1:
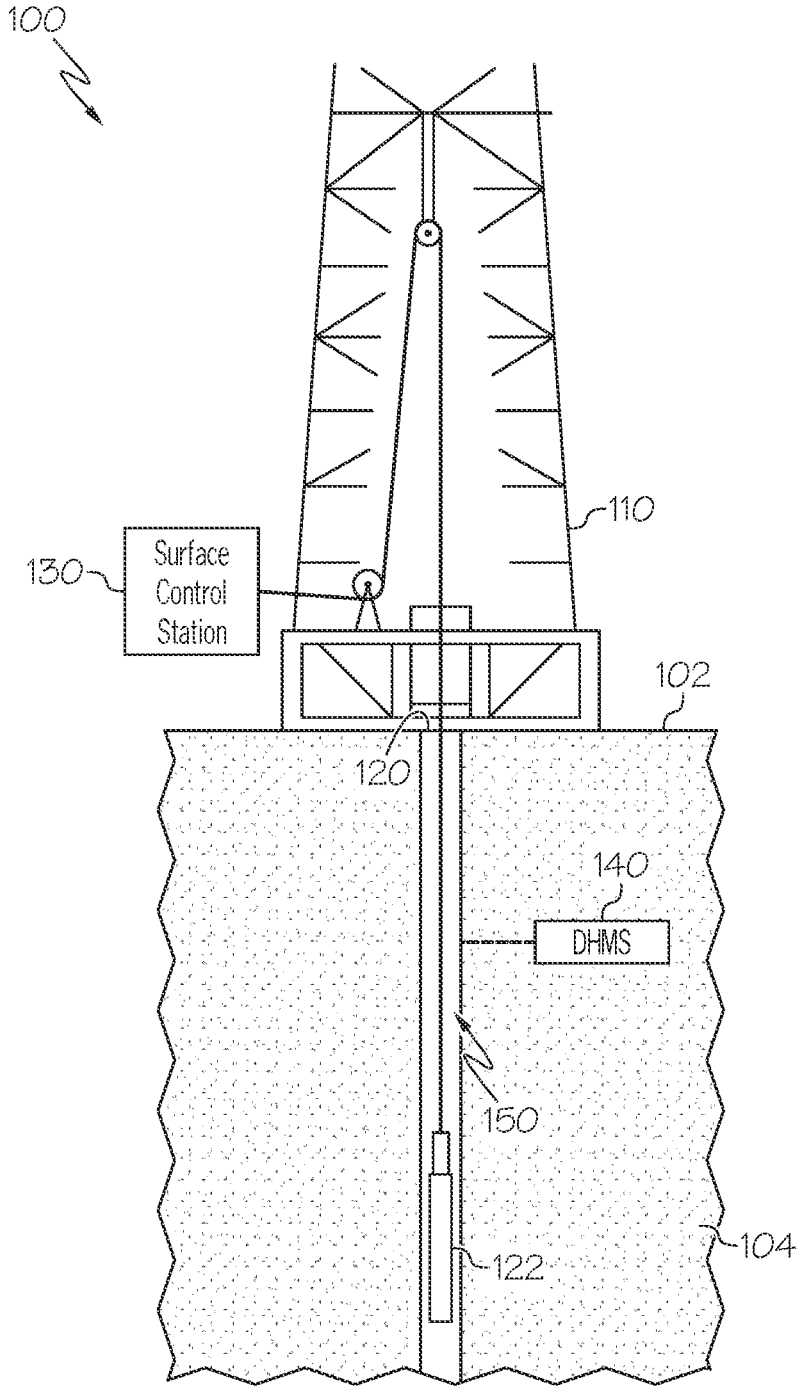
FIG. 1 schematically depicts a well site in which a wellbore has been formed according to the present disclosure.

As described in greater detail further below, embodiments of the present disclosure are directed to systems and methods for determining a productivity index (PI) for an individual lateral (e.g., well branch) of a multilateral well completion of a well under commingled flow with one or more other laterals of the well. The well recovers hydrocarbons such as oil and gas, and the lateral PI is determined under commingled flow with at least another lateral such that the laterals are each simultaneously producing hydrocarbons.

Well operations employ wells to recover hydrocarbons, such as oil and gas, from subterranean formations having hydrocarbon-bearing reservoirs. Creating a well typically involves several stages, including a drilling stage, a completion stage and a production stage. The drilling stage may involve a drilling rig drilling a wellbore, hoisting, lowering and turning drill pipe and tools, circulating drilling fluids in the wellbore, and generally controlling various operations downhole in the wellbore. The wellbore may be drilled with multiple highly deviated or horizontal portions as laterals that extend through separate hydrocarbon-bearing production zones. Multilateral wells include such laterals as well branches extending from a mother bore into the separate hydrocarbon-bearing production zones. Once a well is drilled into a hydrocarbon reservoir, the well may become a producer through the completion stage.

The completion stage involves transforming the drilled well into a producing well such that the well is able to produce hydrocarbons. The mother bore and laterals of smart multilateral wells may be equipped at the completion stage with sensors such as monitoring devices to measure flow properties and control valves to control hydocarbon production to form the well. For example, a smart multilateral well may include a pressure downhole monitoring system ("PDHMS") and an inflow control valve ("ICV") at each lateral.

After the completion stage, the production stage involves producing such hydrocarbons from the reservoir by way of the well completion. Surface valves may be operated in coordination with downhole valves to regulate pressure in the wellbore, control production flow from the wellbore, and provide access to the wellbore in the event further completion work is needed. Flow from an outlet valve may be connected to a distribution network of midstream facilities, such as tanks, pipelines, and transport vehicles, which transport the production to downstream facilities, such as refineries and export terminals.

Multilateral well completions may not include flow rate metering at lateral levels such that each lateral's contributions in non-commingled flow are unknown. In addition, some systems may not be able to accurately quantify the rate flowing through zonal ICVs at laterals owing to the limited pressure drawdown across the zonal ICVs when in a fully open position or other factors. Systems may utilize a trial and error procedure to predict the performance of laterals under commingled flow. Moreover, some systems may propose estimations that are based on zonal dimensions such as the drainage area and relevant reservoir properties against each lateral, which may be unavailable or inaccurate input information.

Embodiments described herein include a productivity index generator 746 (FIG. 7, as described in greater detail below) that may calculate the productivity index (PI) of each individual lateral under commingled flow conditions utilizing the pressure measurement at local PDHMS collected from a comprehensive well testing program. As used herein, such well testing refers to the measurement of stabilized flowrate and pressure under a specific wellhead pressure, or other testing conditions. Well test conditions such as wellhead pressure, reservoir pressure, and vertical flow correlation may be used in the model and then used to determine a specific productivity indices associated with a flowrate that matches the well test.

Accordingly, multilateral well modeling and performance prediction techniques described herein may be used to predict lateral performance under a commingled flow condition in which the laterals are producing. Such determined lateral performance under commingled flow may thereafter be used to conduct inflow balances among laterals to optimize production of the well. A PI of producing individual laterals of such a multilateral well completion under a commingled flow condition may be determined to predict lateral performance. Embodiments herein describe systems and methods for determining the productivity indices of individual laterals based on a determined productivity index ratio of at least two individual laterals under non-commingled flow and a correlation to a determined global productivity index of the multilateral well completion under commingled flow. Determination of respective productivity indices of laterals under commingled flow may optimize production by allowing for well balancing between laterals, modification of ICV parameters, or the like to improve or increase well productivity.

Figure 2:
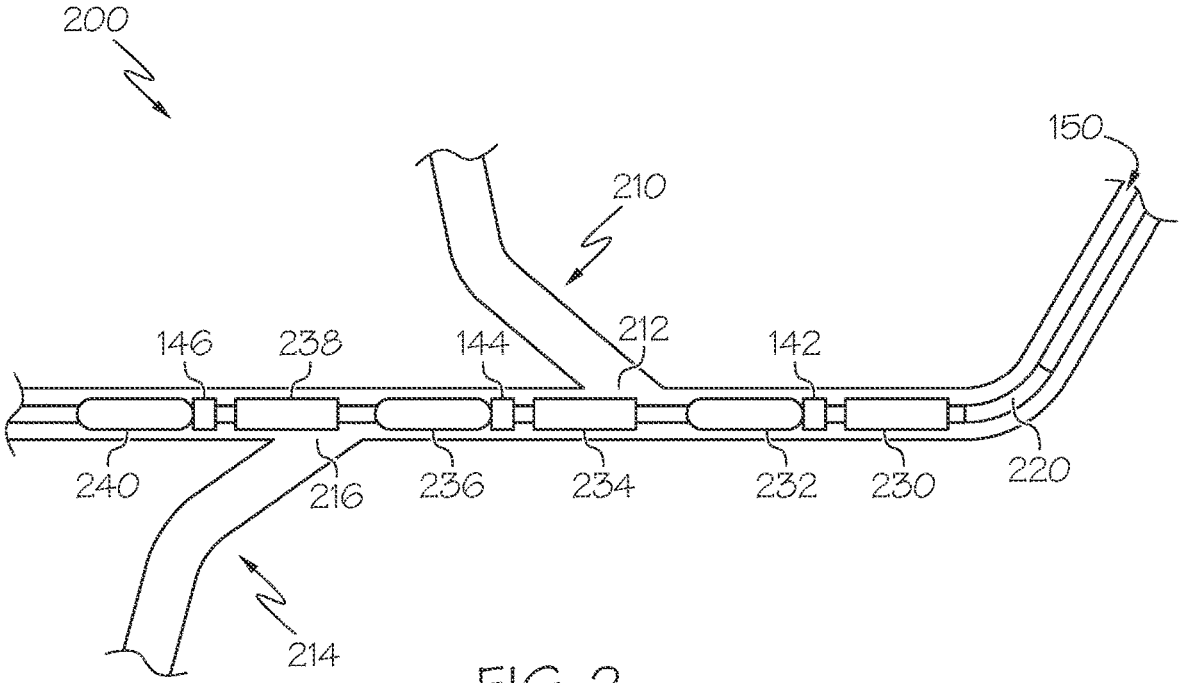
FIG. 2 schematically depicts a multilateral well completion for the well site of FIG. 1 and including an inflow control valve system according to the present disclosure.

Referring initially to FIGS. 1 and 2, a well system 100 includes wellbore 150 formed through a surface 102 and a subterranean formation 104 according to the present disclosure. The wellbore 150 may include a multilateral well completion 200 (FIG. 2) in which zonal ICVs 232, 236, 240 are deployed downhole, in accordance with example embodiments of the present disclosure. Regarding the multilateral well completion 200, to be described in greater detail further below, mechanical packers may be used to prevent flowing through an annulus of the wellbore 150.

Referring again to FIG. 1, the wellbore 150 may comprise a configuration including a vertical alignment with the surface 102, or slant with respect to the surface 102, or an s-type shape and may include multiple production zones. The configuration of the wellbore 150 may be formed in the subterranean formation 104 and coupled to a platform 110 disposed on the surface 102 through a wellhead 120. The wellhead 120 may be used to control the production of hydrocarbons from the multilateral well completion 200. The subterranean formation 104 can include one or more of a number of formation types, including but not limited to shale, limestone, sandstone, clay, sand, and salt. The subterranean formation 104 may be ground level for an onshore application or the sea floor for an off-shore application. In certain embodiments, a subterranean formation 104 can also include one or more reservoirs in which one or more resources are located. The wellbore 150 may include a completion cased with cement or other casing material, which completion may be perforated to allow fluids to flow from the subterranean formation 104 into the wellbore 150. In another aspect, well tools 122 may be disposed in the wellbore 150.

Such well tools 122 may include a production tubing 220 (FIG. 2) disposed downhole within the wellbore 150. Fluids such as hydrocarbons may be recovered and brought to the platform 110 (FIG. 1) through the production tubing 220. In embodiments, the multilateral well completion 200 includes one or more zonal ICVs 232, 236, 240 coupled to the production tubing 220 at various linear portions, such as at each lateral. The ICVs 232, 236, 240, may control the flowrate of produced hydrocarbons from various segments of the multilateral well completion 200. For example, laterals 210, 214 may branch from the wellbore 150 at junctions 212 and 216. The zonal ICV 232, 236 control the flow of fluid from laterals 210, 214 through an amount the zonal ICV 232, 236 is open. Zonal ICV 240 may control the flow of fluid from an additional lateral (not shown) as a well branch off a zone of a mother bore. In embodiments, a packer 230, 234, 238 is placed between each zonal ICV 232, 236, 240, thereby isolating each respective portion of the wellbore 150. The packers 230, 234, 238 may prevent flowing through portions of the multilateral well completion 200, such as one lateral 210, 214. Placement of zonal ICVs 232, 236, 240 and the packers 230, 234, 238 separates the wellbore 150 into one or more well zones. Each of the zonal ICV 232, 236, 240 is configured to independently control the flow rate or shut-in of fluids from the reservoir into the production tubing at its respective zone. For example, each zonal ICV 232, 236 may close to effect a shut-in at a respective lateral 210, 214 or partially or fully open to allow for a flow condition through the respective lateral 210, 214. The production tubing 220 may further be equipped with a PDHMS 140, which may include a PDHMS 142, 144, 146 respectively associated with the ICVs 232, 236, 240.

Readings from the PDHMS 140 alone, however, may not be sufficient to accurately determine a flow rate and resulting productivity index (PI) at each respective lateral 210, 214 when the laterals 210, 214 are producing under commingled flow due to various aspects, such as a limited pressure drawdown across the zonal ICVs 232, 236 at fully open positions. The systems and methods describe herein aid to accurately determine the PI of producing laterals 210, 214 under a commingled flow condition (e.g., when the laterals 210, 214 are producing) to optimize production of the wellbore 150 based on (i) a determined ratio between the PI's of the at least two laterals 210, 214 under non-commingled flow and (ii) a correlation to a determined global PI of the wellbore 150 under commingled flow In embodiments, a surface control station 130 may be located aboveground to permit operators to monitor and control the multilateral well completion 200. The surface control station 130 may include a well operations logic 744 and a productivity index generator 746 (FIG. 7), as described in greater detail further below. The productivity index generator 746 may be configured to communicate wirelessly or with a wired connection with the multilateral well completion 200. This includes receiving data from the multilateral well completion 200 regarding downhole conditions and system conditions. The surface control station 130, through the productivity index generator 746, well operations logic 744, or both, may also be configured to send control signals to the multilateral well completion 200 regarding operation of the zonal ICVs 232, 236, 240 and one or more PDHMS components, such as well tools 142, 144. The PDHMS components may comprise one or more well tools 122, strain-gage instruments, optic sensors, piezoresistance and resonance instruments, moisture sensors, flow meters (e.g., turbine meters), density meters, temperature sensors, or the like. It is further noted that the PDHMS 140 may gather, receive, store, provide, or otherwise process wellbore data, ICV parameters, or other data associated with a well.

According to some example embodiments, the well operations logic 744 may be executed by a computing device and may be operable to receive input from an operator, and transmits corresponding control signals to the multilateral well completion 200. Moreover, the surface control station 130 may include a wireless communications system, wired communications systems, and/or both.

In embodiments, a productivity index generator 746, such as described with reference to FIG. 7, may be used to evaluate the performance of the multilateral well completion 200 using the techniques described herein. The productivity index generator 746 may further be used to provide for the adjustment of wellhead pressures in the wellhead 120 and the adjustment of the zonal ICVs 232, 236, 240. Each of the zonal ICVs 232, 236, 240 may include a power source, communications interfaces, one or more sensing or monitoring devices and one or more valves which may be powered by the power source. The valves of each zonal ICV 232, 236, 240 control the flow of fluids from the respective portion of the subterranean formation 104 or wellbore 150 with which they are associated into the production tubing 220. For example, each zonal ICV 232, 236, 240 may be opened to increase flow, choked back to decrease flow, or closed to shut-in and stop flow, which may allow pressure to build-up at the shut-in location. It is noted that each valve may be controlled by the well operations logic 744 and/or the productivity index generator 746 (as described with reference to FIG. 7).

In another aspect, the zonal ICVs 232, 236, 240 as controlled by the productivity index generator 746 may include one more sensing or monitoring devices that may collect data regarding one or more parameters related to the zonal ICVs 232, 236, 240 at the respective well zone's formation (e.g., laterals 210, 214, and similarly associated zones) as well as production conditions. One or more of the sensing or monitoring devices may comprise part of the PDHMS 140. According to an embodiment, a sensing device may include a flow meter, a pressure sensor, temperature sensor, acoustic sensor, phase detection sensor, or the like. The sensors may be configured to generate data regarding at least one parameter such as flow rate, pressure, temperature, sound, and phase composition of fluids. Such sensors may output generated data to a productivity index generator 746. The productivity index generator 746 includes, stored in memory, a pre-programmed control protocol which determines how to control each of the zonal ICVs 232, 236, 240 based on the received data from the associated sensors.

In embodiments, a methodology for determining the productivity indices of individual producing laterals 210, 214 of multilateral well completion 200 may include determining productivity indices for each lateral 210, 214 under single flow condition where one lateral 210, 214 is flowed at a time and a global productivity index under commingled flow for an entire wellbore 150 is determined. A correlation may then be determined between the productivity indices of laterals under the commingled flow by determining a productivity index ratio C to be utilized along with the global productivity index to determine productivity indices under commingled flow, as described in greater detail further below. It is noted that productivity indices under non-commingled flow may be calculated according to various methodologies.

In an embodiment, the productivity index generator 746 may conduct well testing of the individual laterals under non-commingled flow using the PDHMS 140 to generate real time pressure measurements for each well zone during the respective shut-in and open period for each individual lateral 210, 214, etc., as controlled by the respective zonal ICVs 232, 236, 240. To conduct the well testing of the individual laterals under non-commingled flow the productivity index generator 746 may be operable to close a valve of a zonal ICV 232, 236, 240 on a producing lateral 210, 214, etc. of the multilateral well completion 200 such that the valve closure acts to shut-in the producing lateral and permit an associated pressure build-up in the multilateral well completion 200.

The productivity index generator 746 may then flow fluid through the mother bore separately, which may flow under a limited reservoir pressure drawdown. The PDHMS 140 may provide pressure measurements of the multilateral well completion 200 in real time during the testing. In another example, the wellhead 120 may be operable to adjust a surface choke to achieve a determined reservoir pressure drawdown based on the limited reservoir pressure drawdown and real time pressure measurements by the PDHMS 140.

Further, the productivity index generator 746 may close the respective zonal ICVs 232, 236, 240 for each individual lateral 210, 214, etc. to permit pressure build-up in each individual lateral. The PDHMS 140 may measure pressure, flow rates, or other attributes during the test and may provide the attributes to the productivity index generator 746. The productivity index generator 746 may determine a productivity index $P_{LN}$ for each individual lateral under non-commingled flow based on the real time pressure measurements from PDHMS 142, 144, 146 at each lateral and based on reservoir description parameters, well test conditions, or empirically correlated based on well test results. Well test conditions may include wellhead pressure, reservoir pressure, flow correlation, or the like. Tests may be performed for each of the zonal ICVs 232, 236, 240 such that a productivity index $P_{LN}$ under non-commingled flow may be generated for each of the zonal ICVs 232, 236, 240. In embodiments, pressure measurements at a lateral level may be measured by each PDHMS 142, 144, 146 disposed at a top of each respective ICV 232, 236, 240.

The productivity index generator 746 may determine a productivity index ratio C of at least two individual laterals 210, 214 under non-commingled flow from the generated productivity indices $P_{LN}$. The productivity index ratio C may be calculated based on Equation 1 below.

$$C = \frac{P_{LN1}}{P_{LN2}} \quad \text{(EQUATION 1)}$$

In EQUATION 1 above, here $P_{LN1}$ is the productivity index of a first lateral 210 and $P_{LN2}$ is the productivity index of a second lateral 214. The multilateral well completion 200 may comprise any number of laterals, and any number of productivity index ratio C's may be utilized. For instance, productivity index ratio C's for associated multiple adjacent laterals pairs N:N+1 may be calculated as follows in EQUATIONS 2 and 3 below.

$$C_{1:2} = \frac{P_{LN1}}{P_{LN2}} \quad \text{(EQUATION 2)}$$

$$C_{2:3} = \frac{P_{LN2}}{P_{LN3}} \quad \text{(EQUATION 3)}$$

In another aspect, the productivity index generator 746 may determine a global productivity index $P_G$ of the multilateral well completion 200 under commingled flow based on pressure measurements, well parameters, and/or well testing. Utilizing the zonal ICVs 232, 236, 240 and PDHMS 142, 144, 146 at lateral levels, to conduct well testing to determine a global productivity index $P_G$ of the multilateral well completion 200, the productivity index generator 746 may be operable to open the respective zonal ICVs 232, 236, 240 for each individual lateral 210, 214 and monitor production at the wellhead 120 of the multilateral well completion 200 under a limited reservoir pressure drawdown. The productivity index generator 746 may close the surface choke of the wellhead 120 of the multilateral well completion 200 at the surface 102 to permit pressure build-up. The PDHMS 140 and zonal PDHMS 142, 144, 146, surface sensors, or other instruments may measure pressure and/or other parameters during testing and may utilize the productivity index generator 746 may utilize the measured pressure or other parameters to determine the global productivity index $P_G$ of the multilateral well completion 200 under commingled flow.

In embodiments, productivity indices for each lateral under commingled flow may be determined once such testing is complete based on the determined productivity index ratios C of the laterals under non-commingled flow is determined, and the global productivity index $P_G$ of the multilateral well completion 200 under commingled flow is determined. The productivity index generator 746 may determine productivity indices $P_{LC}$ for each lateral as a function of ratio C and the global productivity index $P_G$ of the multilateral well completion 200 under commingled flow. The productivity index generator 746 may further determine productivity indices $P_{LC}$ as a function of the ratio C, a correlation factor β, and the global productivity index $P_G$.

In an example with two producing laterals 210, 214, embodiments provide for solving for the productivity indices $P_{LC}$ at the lateral level under commingled flow through a correlation. This correlation is identified in the following EQUATIONS 4-6, which equations are extensible to wells comprising any number of laterals.

$$P_{LC1}+P_{LC2}=\beta*P_G \quad \text{(EQUATION 4)}$$

EQUATION 1 may be used to calculate a constant as the productivity index ratio C between the productivity indices of individual laterals 210, 214 under non-commingled flow, which may be assumed to be the same productivity index ratio for the productivity indices of individual laterals 210, 214 under commingled flow as set forth in EQUATION 5 below.

$$\frac{P_{LC1}}{P_{LC2}}=C \quad \text{(EQUATION 5)}$$

In EQUATIONS 4 and 5 above, $P_{LC1}$ and $P_{LC2}$ represent the productivity indices for laterals 210 and 214, respectively, under commingled flow. In EQUATION 4, β is a correlation factor, where β=1 when the productivity indices are calculated at a junction within the tubing as thus may assumed to be one for the methodology employed herein. Thus, once the productivity index ratios C of the laterals 210, 214 under non-commingled flow and the global productivity index $P_G$ are determined, the equations may be solved such that the productivity index $P_{LC1}$ of the first lateral 210 under commingled flow may be calculated according to the following EQUATION 6.

$$P_{LC1}=((\beta*P_G)*C/(C+1) \quad \text{(EQUATION 6)}$$

To arrive at EQUATION 6, a productivity index $P_{LN1}$ of the first individual lateral under non-commingled flow divided by a productivity index $P_{LN2}$ of a second individual lateral of the at least two individual laterals under non-commingled flow is equal to the ratio C, and the productivity index $P_{LC1}$ divided by a productivity index $P_{LC2}$ for the second individual lateral under commingled flow is assumed to equal the ratio C.

The productivity index $P_{LC2}$ of the second lateral 214 under commingled flow may then be calculated according to EQUATION 5 or by the following EQUATION 7 below.

$$P_{LC2}=(\beta*P_G)-P_{LC1} \quad \text{(EQUATION 7)}$$

It is noted that the second productivity index $P_{LC2}$ of the second lateral 214 under commingled flow may be calculated prior to the first productivity index $P_{LC1}$ of the first lateral 210 under commingled flow utilizing the above equations. As such, $P_{LC2}$ may be calculated as set forth in EQUATION 8 below.

$$P_{LC2}=((\beta*P_G))/(C+1) \quad \text{(EQUATION 8)}$$

$P_{LC1}$ may then be calculated according to EQUATION 5 or by the following EQUATION 9 below.

$$P_{LC1}=(\beta*P_G)-P_{LC2} \quad \text{(EQUATION 9)}$$

In embodiments, the productivity index generator 746 may determine adjustments to be made to one or more zonal ICVs 232, 236, 240 based on the determined individual lateral productivity indices $P_{LC}$ under commingled flow. The adjustment may comprise an adjustment to flow rate or other like parameter. In some embodiments, the productivity index generator 746 may determine a liquid production rate Q for each of the laterals 210, 214 as a function of the respective productivity indices $P_{LC}$ under commingled flow. For instance, the productivity index generator 746 may calculate a liquid production $Q_L$ for each lateral as a product of a respective productivity index $P_{LC}$ and a reservoir pressure drawdown ΔP, as measured during commingled flow by the PDHMS 142, 144, 146 at the lateral level, according to the following EQUATION 10.

$$Q_L=\Delta P*P_{LC} \quad \text{(EQUATION 10)}$$

Based on the liquid production $Q_L$ of each lateral, the productivity index generator 746 may control the respective zonal ICVs 232, 236, 240 to modify productivity at lateral levels of respective laterals 210, 214, etc. based on the productivity index $P_{LC}$ to achieve a desired total global liquid production rate $Q_t$. The global liquid production rate $Q_t$ comprises a summation of the liquid production rates $Q_L$. The global liquid production rate $Q_t$ for two laterals 210, 214, for example, may be expressed as set forth below in EQUATION 11, in which $q_1$ is representative of a liquid production rate of the first lateral 210 under commingled flow and $q_2$ is representative of a liquid production rate of the second lateral 214 under commingled flow.

$$Q_t=q_1+q_2 \quad \text{(EQUATION 11)}$$

In an aspect, the productivity index generator 746 may enable users, such as petroleum engineers, to quantify the liquid rate from each lateral 210, 214, etc. when the laterals 210, 214, etc. are producing and thus are under commingled flow to optimize production at the lateral level using the zonal ICVs 232, 236, 240 to control inflow balancing between the laterals. Production of the multilateral well completion 200 may be monitored, recorded, or otherwise stored. In embodiments, a history of production and well parameters for the multilateral well completion 200 may be utilized to model future wells, evaluate well performance, or the like. Moreover, the productivity index generator 746 may measure the interference effect among the laterals 210, 214, etc. to optimize lateral spacing of the existing multilateral well completion 200 and reservoir contact of the future wells.

In another example with three producing laterals, the productivity indices $P_{LC}$ may similarly be determined at the lateral level under commingled flow through a correlation as described herein and set forth below. This correlation is identified in the following EQUATIONS 12-17, which are extendable to wells comprising any number of laterals.

$$P_{LC1}+P_{LC2}+P_{LC3}=\beta*P_G \quad \text{(EQUATION 12)}$$

$$\frac{P_{LN1}}{P_{LN2}}=C_1 \quad \text{(EQUATION 13)}$$

$$\frac{P_{LN1}}{P_{LN3}}=C_2 \quad \text{(EQUATION 14)}$$

$$\frac{P_{LC1}}{P_{LC2}}=C_1 \quad \text{(EQUATION 15)}$$

$$\frac{P_{LC1}}{P_{LC3}}=C_2 \quad \text{(EQUATION 16)}$$

Thus, the productivity index $P_{LC1}$ of the first lateral under commingled flow may be solved by the equation set forth below as EQUATION 17.

$$P_{LC1}=\frac{(\beta*P_G)}{C_1+C_2+1} \quad \text{(EQUATION 17)}$$

The productivity indices $P_{LC2}$ and $P_{LC3}$ of the second and third laterals under commingled flow may similarly be calculated based on similarly solving the above EQUATIONS 12-16 for the productivity indices $P_{LC2}$ and $P_{LC3}$ under commingled flow. Further, the global liquid production rate $Q_t$ also includes a summation of the liquid production rates $Q_L$ as described herein. Accordingly, adjustments to each of the zonal ICVs 232, 236, 240 may be made to control individual lateral liquid production rates based on the determined productivity indices.

According to some embodiments, the productivity index generator 746 may conduct inflow balancing among the laterals 210, 214, etc. by adjusting the position of the zonal ICVs 232, 236, 240 relative to a lateral of interest through the real-time production optimization practice. Real-time production optimization practices may utilize a constrained model developed to recalculate optimum values of set points on a regular basis in response to any change in parameters (for example, supply flow rates and demands). Real-time production optimization practices may enhance the multilateral well completion 200 inflow performance, reduce restriction in the outflow performance, increase production with less pressure drawdown, or the like. In another example, the productivity index generator 746 may reduce deferred production by means of reactive, preventive, or predictive actions, increase surface equipment availability by means of reliability centered maintenance, or reduce operating costs by determining an optimum balance of produced fluids.

In some embodiments, the productivity index generator 746 may generate inflow performance relationship (IPR) plots describing a relationship of liquid inflow rate to bottom hole flowing pressure for each lateral 210, 214 of the multilateral well completion 200 based on the productivity index $P_{LC}$ for each individual lateral 210, 214 under commingled flow to identify respective production contribution at a reservoir drawdown pressure to optimize production. The IPR plots may be utilized to determine deliverability for a well.

The productivity index generator 746 may utilize a model to confirm that the measured and calculated downhole pressure and rates are matched within acceptable error range, such as less than 5%. For instance, the productivity index generator 746 may compare the liquid production rates $Q_L$ for each lateral to a measured total global liquid production rate $Q_t$ at the reservoir drawdown pressure. In response to the sum of the production rates $Q_L$ exceeding an error rate in comparison to the global liquid production rate $Q_t$, the productivity index generator 746 may generate an alert indicative of an unacceptable error when the liquid production rate is over 5% of the measured total liquid production rate. The alert may comprise an audible, visual, tactile (e.g., vibration), or other alert. In some embodiments, the alert may comprise generation of a notification on an electronic display, generation of an electronic communication, or the like.

Accordingly, the determined productivity of laterals 210, 214 under commingled flow conditions may be utilized to further determine the performance of the multilateral well completion 200 at lateral levels. Operators may quantify the liquid rate from each lateral 210, 214 when they are on production in commingled flow such that productivity may be improved, optimized, or otherwise altered at lateral levels using the zonal ICV per lateral.

EXAMPLES

Figure 3:
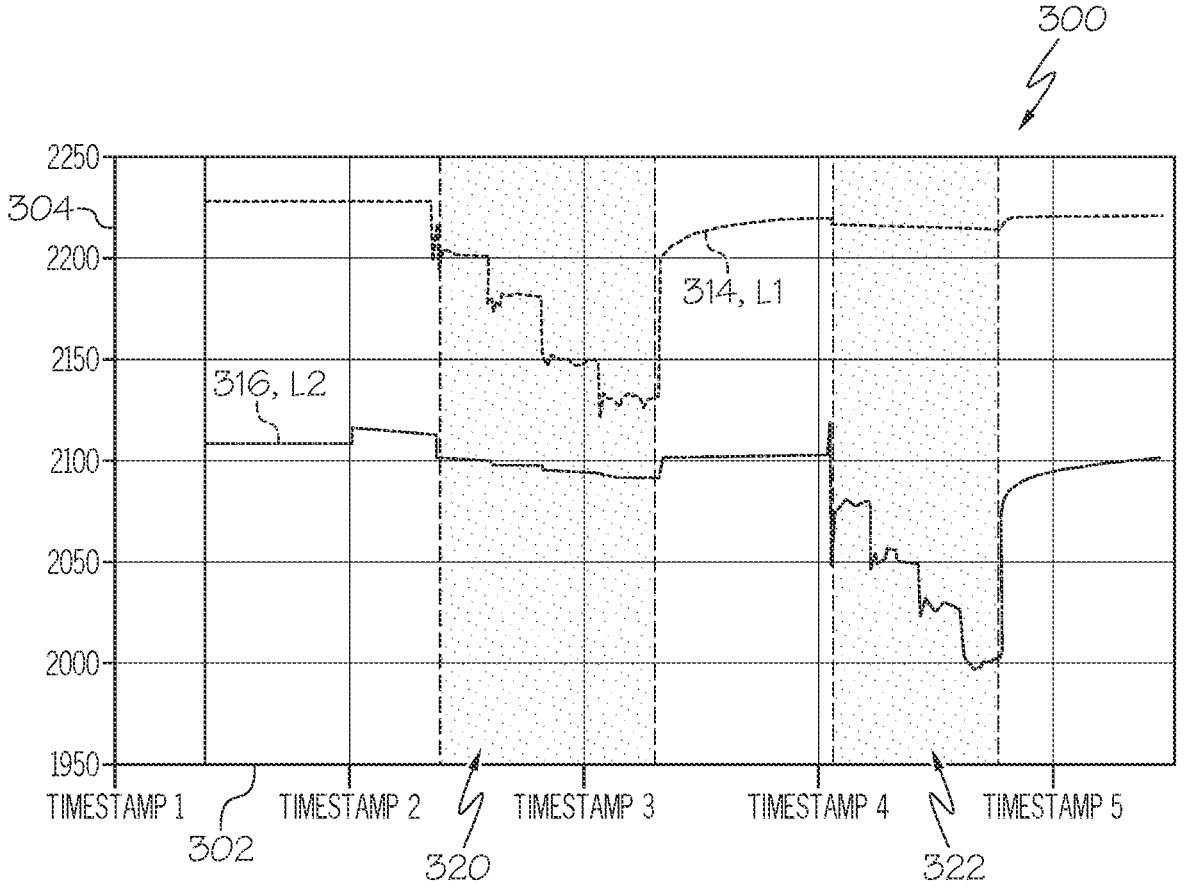
FIG. 3 illustrates a graph depicting pressure measurements at separately flowed laterals of a multilateral well completion according to one or more embodiments shown and described herein.
Figure 4:
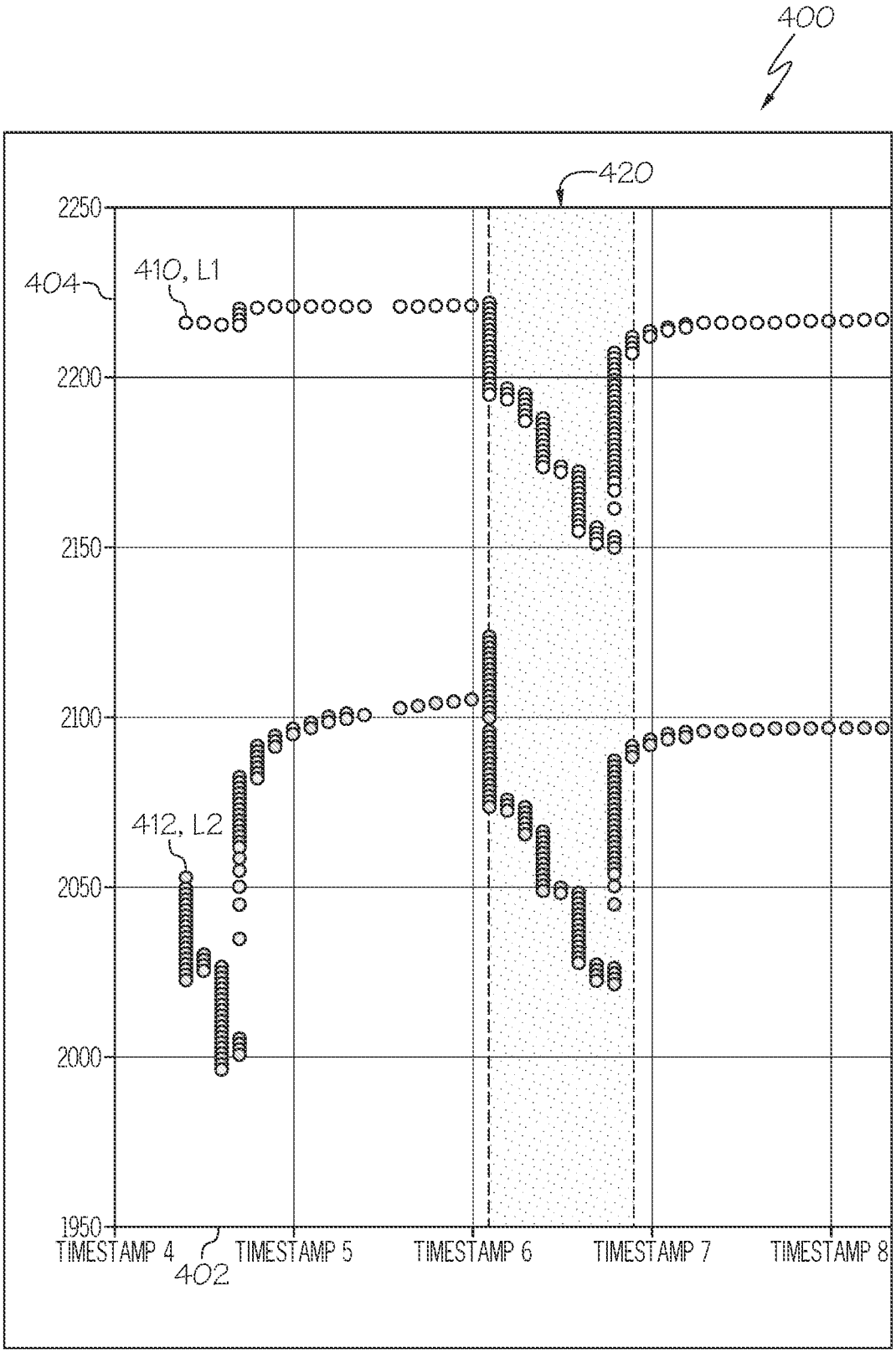
FIG. 4 illustrates a graph depicting pressure measurements at laterals of a multilateral well completion under commingled flow according to one or more embodiments shown and described herein.

FIG. 3 schematically depicts a graph 300 depicting pressure measurements at laterals of a multilateral well completion according to one or more embodiments shown and described herein. The graph 300 includes a date on the x-axis 302 and a flowing bottom hole pressure (FBHP) in pounds per square inch (psi) on the y-axis 304. The graph 300 includes information gathered by the PDHMS 140 during validation tests run at times 320 and 322 at increasing choke sizes followed by prolonged periods of pressure build-up conducted on a first lateral L1 (top graph portion) and second lateral L2 (bottom graph portion). The first lateral L1 and the second lateral L2 were tested separately such that they were not tested under commingled flow. Pressure measurements of the first lateral L1 are depicted at line 314. Pressure measurements of the second lateral L2 are depicted at line 316. The pressure measurements may comprise real time pressure measurements that may be measured by zonal PDHMS 142, 144, 146 at lateral levels at the top of zonal ICVs 232, 236, 240. The first lateral L1 may be flowing while other laterals, such as the second lateral L2, is shut in until Timestamp 4. At Sep. 27, 2016, the second lateral L2 may be flowing at Timestamp 4 and the first lateral L1 may be shut in. In FIGS. 3-4, the Timestamps are separated by 10 day periods.

FIG. 4 schematically depicts a graph 400 depicting pressure measurements at laterals L1, L2 of the multilateral well completion tested under commingled flow according to one or more embodiments shown and described herein. The graph 400 includes a date on the x-axis 402 and a FBHP in psig on the y-axis 404. The graph 400 includes information gathered by a PDHMS during tests run at times 420 showing pressure measurements during commingled flow of the first lateral L1 as depicted at line 410 commingled. Pressure measurements during commingled flow of the second lateral L2 are depicted at line 412 commingled.

The productivity indices $P_{LN1}$, $P_{LN2}$ for the first lateral L1 and the second lateral L2 under single flow condition (e.g., non-commingled flow) and the global productivity index $P_G$ under commingled flow are able to be calculated from the graphs 300, 400 of FIGS. 3 and 4. EQUATION 1 may be used to calculate the productivity index ratio C, which may be inserted into EQUATION 5. Then, as a manipulation of EQUATION 5, $P_{LC2}=P_{LC1}/C$ may be substituted into EQUATION 4 to calculate the first productivity index $P_{LC1}$ of the first lateral 210 under commingled flow.

The calculated first productivity index $P_{LC1}$ of the first lateral 210 under commingled flow may then be used in EQUATION 4 to calculate the second productivity index $P_{LC2}$ of the second lateral 214 under commingled flow. Further, the liquid production rates $q_1$, $q_2$ of the first and second laterals 210, 214 under commingled flow are determined from EQUATION 10 (individually substituting the liquid production rates $q_1$, $q_2$, as the liquid production $Q_L$ of each lateral) to generate the production contributions from each lateral under commingled flow.

Figure 5A:
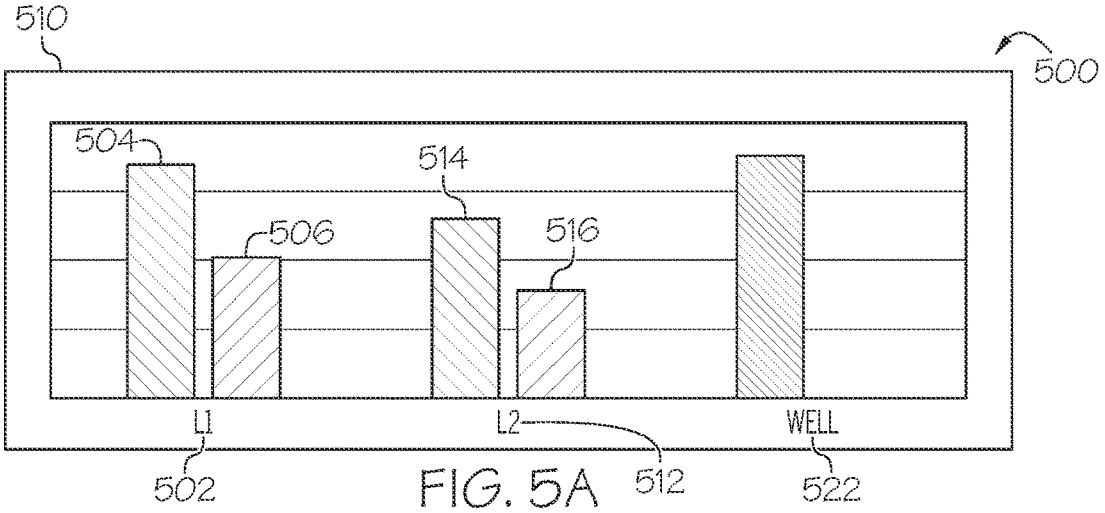
FIG. 5A depicts a graph depicting productivity indices of dual laterals of a multilateral well completion under both separate flow and commingled flow according to one or more embodiments shown and described herein.

FIG. 5A schematically depicts a graph 500 showing productivity indices for the first lateral L1, 502 and the second lateral L2, 512 of a dual-lateral tested well under the tested single flow of FIG. 3 and commingled flow of FIG. 4. The productivity index 504 for the first lateral L1, 502 illustrates the productivity index under non-commingled flow. The productivity index 514 for the second lateral L2, 512 illustrates the productivity index under non-commingled flow. The productivity index 506 for the first lateral L1, 502 illustrates the productivity index under commingled flow as may be calculated by the productivity index generator 746 as described herein. The productivity index 516 for second lateral L2, 512 illustrates the productivity index under commingled flow as may be calculated by the productivity index generator 746. A calculated global productivity index $P_G$ of the well under commingled flow is identified as global productivity index 522. In an aspect, the productivity indices may be measured in units of stock tank barrels per day and in pounds per square inch (STB/Day Psi). As illustrated, the calculated productivity indices 506 and 516 under commingled flow for the respective first and second laterals L1, 502 and L2, 512 are less than the respective productivity indices 504 and 514 under non-commingled flow when the first and second laterals L1, 502 and L2, 512 were tested separately.

FIG. 5A thus shows that the calculated PIs for the laterals L1, L2 (e.g., the laterals 210, 214) when they are producing together under commingled flow (FIG. 4) are less than when were tested separately under non-commingled flow (FIG. 3). Such an effect may be due to an interference effect between the laterals L1, L2, particularly when the lateral L1, L2 are completed at a same completion depth. However, the outcomes of the single multiphase modelling calibrated at the lateral level when tested separately (FIG. 3), generally match the measured downhole pressure and surface production rate when all the laterals are producing under commingled flow (FIG. 4).

Figure 5B:
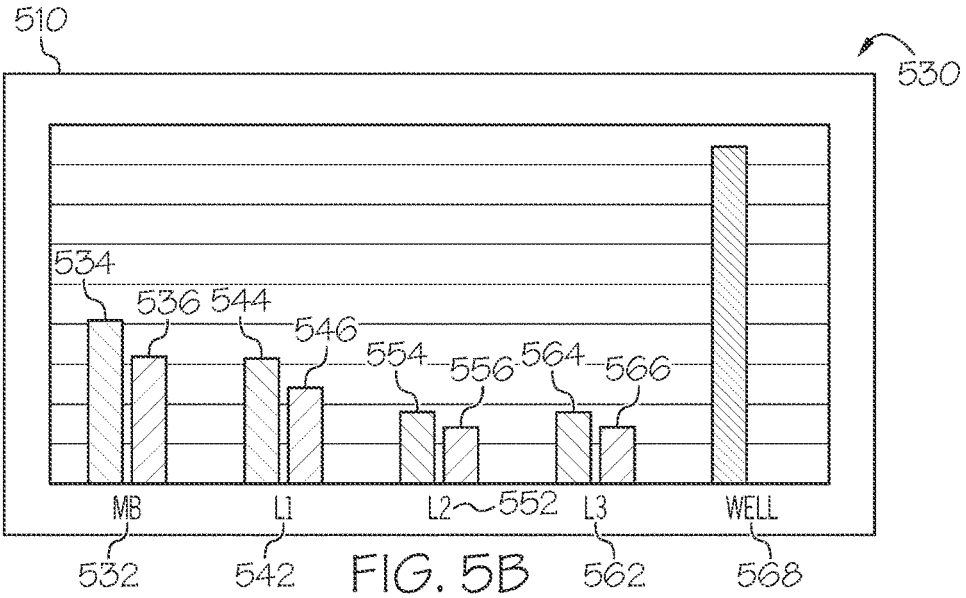
FIG. 5B depicts a graph depicting productivity indices of a quad-lateral completion of a well under both separate flow and commingled flow and a global productivity index of the well according to one or more embodiments shown and described herein.

FIG. 5B schematically depicts a graph 530 showing productivity indices for a quad-lateral completion that includes four laterals 532, 542, 552, and 562. The graph 530 illustrates calculated productivity indices for each of the laterals 532, 542, 552, and 562 under non-commingled flow and under commingled flow. Lateral L4, 532 includes a non-commingled productivity index 534 and a commingled productivity index 536. Lateral L1, 542 depicts a non-commingled productivity index 544 and a commingled productivity index 546. Lateral L2, 552 depicts a non-commingled productivity index 554 and a commingled productivity index 556. Lateral L3, 562 depicts a non-commingled productivity index 564 and a commingled productivity index 566. A calculated global productivity index $P_G$ of the well under commingled flow is identified as global productivity index 568.

With respect to the quad-lateral completion example of FIG. 5B, measurements and calculated values are set forth below in TABLE 1. WHP is representative of well hole pressure in pounds per square inch gauge ("psig") and shows a zero error percentage, Tubing PDHMS is representative of pressure at a tubing location and shows an error percentage of 4.3%, Downhole PDHMS is representative of pressure at a downhole location and shows an error percentage of 1.3%, and a liquid production measured in units of reservoir volume ("rbbl") shows an error percentage of 3.7%.

TABLE 1

| | Measured | Calculated | Error % |
|---|---|---|---|
| WHP, psig | 828 | 828 | 0.0 |
| TUBING PDHMS, psig | 1691 | 1764 | 4.3 |
| Downhole PDHMS, psig | 2300 | 2270 | 1.3 |
| Liquid: rbbl/day | 7800 | 7513 | 3.7 |

Figure 5C:
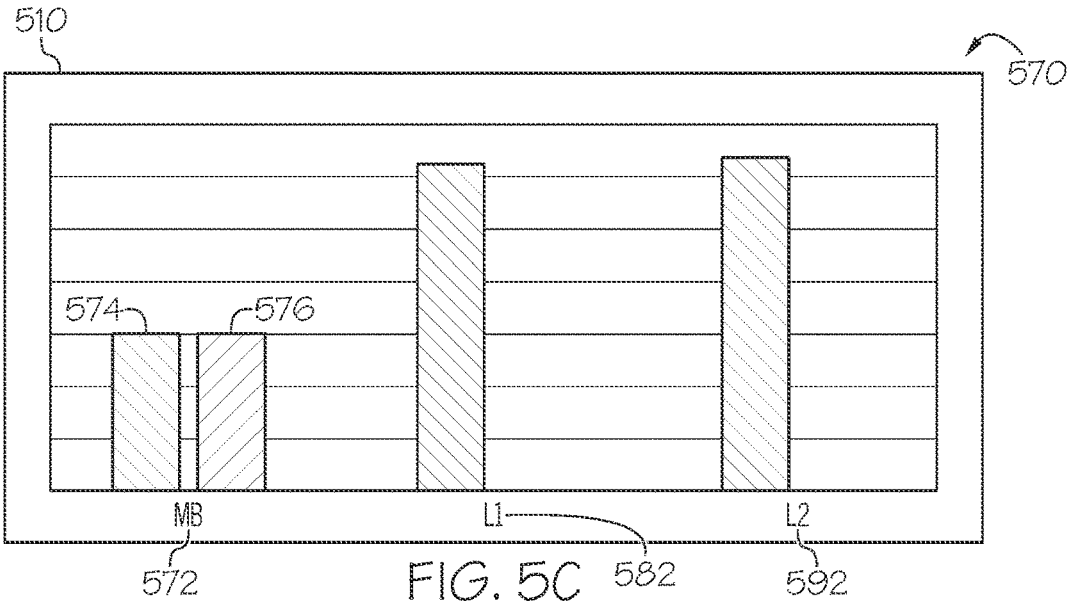
FIG. 5C illustrates a graph depicting calculated and measured oil rates for a tri-lateral completion according to one or more embodiments shown and described herein.

FIG. 5C schematically depicts a graph 570 showing oil rates for a tri-lateral completion as tested, where the mother bore MB is divided into two segments and an integrated station for downhole liquid metering is placed in each segment. The graph 570 illustrates outcomes of the correlations described herein as matching the down hole liquid metering in the tri-lateral smart well. The graph 570 illustrates a calculated oil rate 582 for a first lateral L1, a calculated oil rate 592 for a second lateral, a calculated oil rate 574 for a mother bore 572 and a measured oil rate 576 for the mother bore 572. As illustrated, the calculated oil rate at 574 matched the measured oil rate at 576 based on down hole liquid metering.

Figure 6:
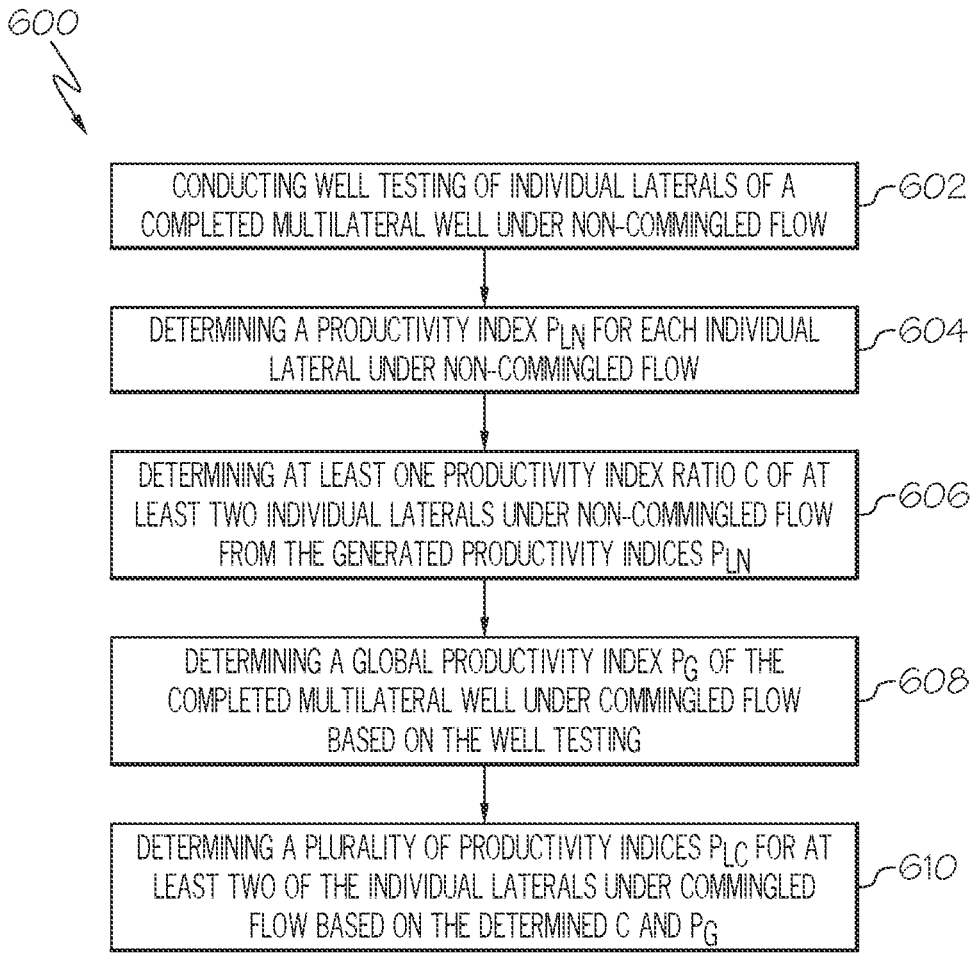
FIG. 6 depicts a flowchart illustrating a method of determining the productivity index of individual producing laterals under commingled flow according to one or more embodiments shown and described herein.

In view of the subject matter described herein, methods that may be related to various embodiments may be better appreciated with reference to the flowchart of FIG. 6. The flow chart of FIG. 6 depicts an example method 600. While the methods are shown and described as a series of blocks, it is noted that associated methods or processes are not limited by the order of the blocks. It is further noted that some blocks and corresponding actions may occur in different orders or concurrently with other blocks. Moreover, different blocks or actions may be utilized to implement the methods described hereinafter. Various actions may be completed by one or more of users, mechanical machines, automated assembly machines (e.g., including one or more processors or computing devices), or the like.

FIG. 6 depicts an example flowchart of non-limiting method 600 associated with systems for determining individual productivity indices for producing laterals, according to various aspects of the subject disclosure. As an example, the method 600 may be for determining the productivity indices for individual laterals of a completed multilateral well under commingled flow, the completed multilateral well comprising a mother bore and a plurality of laterals extending from the mother bore in corresponding well zones of the mother bore.

At block 602, a system, such as a system 700 (FIG. 7), described in greater detail below, may implement the method 600 to conduct well testing of individual laterals of a plurality of laterals of a completed multilateral well under non-commingled flow. The system 700 may conduct the well testing using a PDHMS as described herein to generate real time pressure measurements for each well zone during respective shut-in and open periods for each individual lateral as controlled by respective zonal ICVs. Each zonal ICV respectively controls commingled flow of an individual lateral of the plurality of laterals of the completed multilateral well. Conducting the well testing of the individual laterals under non-commingled flow may include closing a valve on a producer of the completed multilateral well such that the valve closure acts to shut-in the producer and permit pressure build-up in the completed multilateral well, flowing fluid through the mother bore separately under a limited reservoir pressure drawdown, adjusting a surface choke at a surface of the multilateral well to achieve a determined reservoir pressure drawdown based on the limited reservoir pressure drawdown and real time pressure measurements by the PDHMS, and closing the respective zonal ICV for each individual lateral to permit pressure build-up in each individual lateral.

At block 604, the method 600 may determine a productivity index $P_{LN}$ for each individual lateral under non-commingled flow based on the real time pressure measurements from the well testing using the zonal ICVs and PDHMS. At block 606, and as described herein, at least one productivity index ratio C of at least two individual laterals under non-commingled flow may be determined from the respective generated productivity indices $P_{LN}$.

At block 608, the global productivity index $P_G$ of the completed multilateral well may be determined under commingled flow based on the well testing using the zonal ICVs and PDHMS as described herein. To determine the global productivity index $P_G$, the method 600 may include opening the respective zonal ICV for each individual lateral, monitoring production at the surface of the completed multilateral well under the limited reservoir pressure drawdown, and closing the surface choke of the completed multilateral well at the surface to permit pressure build-up.

At block 610, the productivity indices $P_{LC}$ for at least two of the individual laterals under commingled flow may be determined as described herein based on (i) the determined productivity index ratio C of at least two individual laterals under non-commingled flow and (ii) the determined global productivity index $P_G$ of the completed multilateral well under commingled flow.

In embodiments, the method 600 may further include using the productivity index generator 746 of the system 700 to determine a liquid production rate for the at least two of the individual laterals under commingled flow based on the productivity index $P_{LC}$ and a reservoir drawdown pressure, compare the liquid production rate to a measured total liquid production rate at the reservoir drawdown pressure, and generate an alert indicative of an unacceptable error when the liquid production rate is over 5% of the measured total liquid production rate. Additionally or alternatively, the method 600 may further include controlling the zonal ICVs to modify the flow of the individual laterals based on the productivity index $P_{LC}$ for the at least two of the individual laterals to optimize production.

The productivity index generator 746 may further be employed by the method 600 to generate an inflow performance relationship (IPR) plot per individual lateral based on the productivity index $P_{LC}$ for each individual lateral to identify respective production contribution at a reservoir drawdown pressure. In embodiments, and as described herein, the productivity index generator 746 may be further operable to determine a productivity index $P_{LC1}$ for a first individual lateral of the at least two of the individual laterals under commingled flow as a function of the ratio C, a correlation factor β, and the global productivity index $P_G$. The function may be EQUATION 6 as set forth herein. The productivity index generator 746 may then be further operable to determine the productivity index $P_{LC2}$ for the second individual lateral under commingled flow using EQUATION 7 as set forth herein.

In embodiments, the productivity index generator 746 may be operable to calculate liquid production rates Q for the at least two of the individual laterals under commingled flow as a function of a reservoir pressure drawdown ΔP measured during the commingled flow and the determined productivity index $P_{LC}$. By way of example, and not as a limitation, the productivity index generator 746 may further use EQUATIONS 10-11 for such calculations. Thus, the productivity index generator 746 may use EQUATION 10 to determine the liquid production rates Q for each of the individual laterals (setting each respective Q to $Q_L$ as set forth in EQUATION 10) and may control the respective zonal ICVs to modify productivity at lateral levels based on the productivity index $P_{LC}$ to determine a global total liquid production rate $Q_t$. The global liquid production rate $Q_t$ may be a summation of the liquid production rates Q. FIG. 7 depicts the system 700 for performing the functionalities as described herein to determine the productivity index of producing laterals. The system 700 may include a computing device 730, which comprises one or more processors 702, a communication path 704, one or more memory devices 706, network interface hardware 712, and a data storage device 714, the details of which will be set forth in the following paragraphs. It should be understood that the system 700 of FIG. 7 is provided for illustrative purposes only, and that other computing systems comprising more, fewer, or different components may be utilized. It is further noted that components of the system 700 may be comprised within a single device or distributed among devices. For instance, portions of the computing device 730 may reside within a system for determining the productivity index of producing laterals, or the like.

Each of the one or more processors 702 may be any device capable of executing computer readable and executable instructions. Accordingly, each of the one or more processors 702 may be a controller, an integrated circuit, a microchip, a computer, or any other computing device. The one or more processors 702 are coupled to a communication path 704 that provides signal interconnectivity between various modules of the computing system 700. Accordingly, the communication path 704 may communicatively couple any number of processors 702 with one another, and allow the modules coupled to the communication path 704 to operate in a distributed computing environment. Specifically, each of the modules may operate as a node that may send and/or receive data. As used herein, the term "communicatively coupled" means that coupled components are capable of exchanging data signals with one another such as, for example, electrical signals via conductive medium, electromagnetic signals via air, optical signals via optical waveguides, and the like.

Accordingly, the communication path 704 may be formed from any medium that is capable of transmitting a signal such as, for example, conductive wires, conductive traces, optical waveguides, or the like. In some embodiments, the communication path 704 may facilitate the transmission of wireless signals, such as WiFi, Bluetooth®, Near Field Communication (NFC) and the like. Moreover, the communication path 704 may be formed from a combination of mediums capable of transmitting signals. In one embodiment, the communication path 704 comprises a combination of conductive traces, conductive wires, connectors, and buses that cooperate to permit the transmission of electrical data signals to components such as processors, memories, sensors, input devices, output devices, and communication devices. Accordingly, the communication path 704 may comprise a vehicle bus, such as for example a LIN bus, a CAN bus, a VAN bus, and the like. Additionally, it is noted that the term "signal" means a waveform (e.g., electrical, optical, magnetic, mechanical or electromagnetic), such as DC, AC, sinusoidal-wave, triangular-wave, square-wave, vibration, and the like, capable of traveling through a medium.

The system 700 includes one or more memory devices 706 coupled to the communication path 704. The one or more memory devices 706 may comprise RAM, ROM, flash memories, hard drives, or any device capable of storing computer readable and executable instructions such that the computer readable and executable instructions can be accessed by the one or more processors 702. The computer readable and executable instructions may comprise logic or algorithm(s) written in any programming language of any generation (e.g., 1GL, 2GL, 3GL, 4GL, or 5GL) such as, for example, machine language that may be directly executed by the processor, or assembly language, object-oriented programming (OOP), scripting languages, microcode, etc., that may be compiled or assembled into computer readable and executable instructions and stored on the one or more memory devices 706. Alternatively, the computer readable and executable instructions may be written in a hardware description language (HDL), such as logic implemented via either a field-programmable gate array (FPGA) configuration or an application-specific integrated circuit (ASIC), or their equivalents. Accordingly, the methods described herein may be implemented in any conventional computer programming language, as pre-programmed hardware elements, or as a combination of hardware and software components.

The one or more memory devices 706 may be configured as volatile and/or nonvolatile memory and, as such, may include random access memory (including SRAM, DRAM, and/or other types of RAM), flash memory, secure digital (SD) memory, registers, compact discs (CD), digital versatile discs (DVD), and/or other types of non-transitory computer-readable mediums. The one or more memory devices 706 include logic in the form of computer readable instructions that perform the functionalities described herein. The one or more memory devices 706 may be configured to store the operating logic 742, the well operations logic 744, and logic for the productivity index generator 746 (each of which may be embodied as a computer program (e.g., computer readable instructions), firmware, or hardware, as an example). The operating logic 742 may include an operating system and/or other software for managing components of the computing device 730.

In another aspect, the well operations logic 744 may reside in the memory devices 706 and may be configured to facilitate monitoring and controlling of the multilateral completion 200. The well operations logic 744 may be configured to generate alerts, store usage logs, receive status updates, control ICVs, interface with a PDHMS, receive measurements, or the like. The well operations logic 744 may be configured to provide other aspects disclosed herein.

Logic for the productivity index generator 746 may reside in the memory devices 706 and may be executed by the one or more processors 702 as the productivity index generator 746. The productivity index generator 746 may be configured to facilitate monitoring of the multilateral well completion 200 and/or utilize the well operations logic 744 to conduct tests, calculate productivity indices, optimize a well, or provide other aspects disclosed herein. In at least some embodiments, the productivity index generator 746 may receive well tool data 716, which may be stored in memory (e.g., data storage device 714) and/or received from well tools communicatively coupled to the productivity index generator 746 through the network 740.

In one example embodiment, the multilateral well completion 200 may be controlled from the surface 102 by the productivity index generator 746 in order to normalize the flow rate across each of the one or more zonal ICVs, conduct well testing, or the like. For example, the productivity index generator 746 receives data regarding the flow conditions at each of the one or more zonal ICVs, and calculates productivity indices for commingled flow conditions. The productivity index generator 746 may be used to determine choke size, flow-rates, or other parameters for each of the each of the one or more zonal ICVs to increase or optimize fluid production for a multilateral well completion.

The data storage device 714, which may generally be a storage medium, may contain one or more data repositories for storing data that is received and/or generated, and may be any physical storage medium, including, but not limited to, a hard disk drive (HDD), memory, removable storage, and/or the like. While the data storage device 714 is depicted as a local device, it should be understood that the data storage device 714 may be a remote storage device, such as, for example, a server computing device or the like. It should be understood that the data storage device is not provided in some embodiments.

Figure 7:
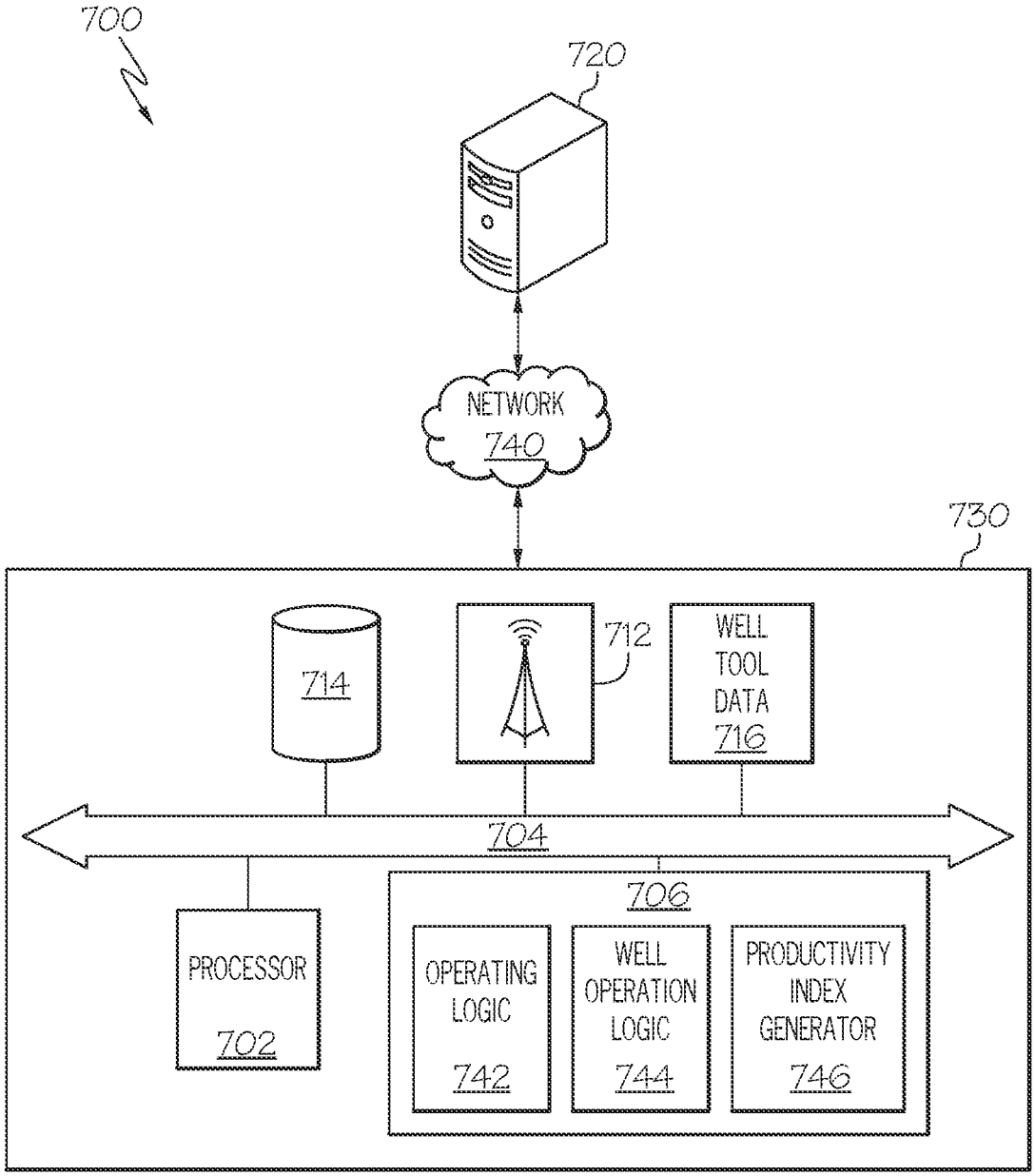
FIG. 7 schematically depicts a computing infrastructure and system for use with the completed multilateral well of FIGS. 1-2 and process of FIG. 6 according to one or more embodiments shown and described herein.

Still referring to FIG. 7, the system 700 may comprise network interface hardware 712 for communicatively coupling the computing system 700 to a remote computing device 720, such as, without limitation, the multilateral well completion 200 and/or a remote server. The network interface hardware 712 can be communicatively coupled to the communication path 704 and can be any device capable of transmitting and/or receiving data via a network 740. Accordingly, the network interface hardware 712 can include a communication transceiver for sending and/or receiving wireless communications. For example, the network interface hardware 712 may include an antenna, a modem, LAN port, Wi-Fi card, WiMax card, mobile communications hardware, near-field communication hardware, satellite communication hardware and/or any wired or wireless hardware for communicating with other networks and/or devices. In one embodiment, the network interface hardware 712 includes hardware configured to operate in accordance with the Bluetooth® wireless communication protocol.

The remote computing device 720 may allow an administrative user to monitor productivity of a multilateral well, gather historical records, or the like. The remote computing device 720 may, for example, receive data identifying productivity indices, system states, well tool data 716, or other aspects as described herein.

Accordingly, the systems and methods described herein implement a methodology to determine a productivity index of individual laterals of smart multilateral wells when they are producing in combination under commingled flow. As described in detail herein, a comprehensive well testing may be conducted on each individual lateral separately to determine productivity indices under non-commingled flow and also on the well level when all laterals are producing under commingled flow. Outcomes of the comprehensive well testing may be used to determine the productivity indices of individual laterals under commingled flow using the correlation and equations as described herein.

In embodiments as described herein, the methodology may include shutting-in a producer well for a period of time, such as a few days, to build pressure, and then flowing a mother bore of the well separately under a limited reservoir pressure drawdown. Real-time measurements at zonal PDHMS readings may be monitored to achieve a reservoir pressure drawdown by adjusting a surface choke size. A pressure build-up test for individual laterals may then separately be employed by shutting in each tested lateral separately utilizing the associated zonal ICV by closing the zonal ICV to stop flow and build up pressure. The productivity index for each separately tested lateral under non-commingled flow may then be calculated. All laterals may then be placed on production under commingled flow such that all associated zonal ICVs are opened. A surface production test under the limited reservoir pressure drawdown may then be conducted in which the well is shut-in at the surface 102 to build up pressure, and then the global productivity index at the well level is determined. The productivity indices of the laterals under commingled flow may then be determined using a correlation between the calculated productivity index for each separately tested lateral under non-commingled flow and the determined global productivity index at the well level as described herein.

The determined productivity indices of individual laterals under commingled flow may be used to optimize well production. In embodiments, the determined productivity indices of individual laterals under commingled flow may be used to generate IPR plots per respective lateral to identify respective production contributions at a specific reservoir drawdown pressure and/or conduct inflow balancing among the laterals by adjusting the position of the zonal ICV against an associated lateral of interest to optimize production in real-time. The determined productivity indices of individual laterals under commingled flow may additionally or alternatively be used to measure an interference effect among the lateral to optimize and improve upon lateral spacing of existing wells and reservoir contact planning of future wells and/or to calibration and improve a predictability of a reservoir simulation model.

It is noted that recitations herein of a component of the present disclosure being "configured" or "programmed" in a particular way, to embody a particular property, or to function in a particular manner, are structural recitations, as opposed to recitations of intended use. More specifically, the references herein to the manner in which a component is "configured" or "programmed" denotes an existing physical condition of the component and, as such, is to be taken as a definite recitation of the structural characteristics of the component.

For the purposes of describing and defining the present invention, it is noted that reference herein to a variable being a "function" of a parameter or another variable is not intended to denote that the variable is exclusively a function of the listed parameter or variable. Rather, reference herein to a variable that is a "function" of a listed parameter is intended to be open ended such that the variable may be a function of a single parameter or a plurality of parameters.

It is also noted that recitations herein of "at least one" component, element, etc., should not be used to create an inference that the alternative use of the articles "a" or "an" should be limited to a single component, element, etc.

It is noted that recitations herein of a component of the present disclosure being "configured" or "programmed" in a particular way, to embody a particular property, or to function in a particular manner, are structural recitations, as opposed to recitations of intended use. More specifically, the references herein to the manner in which a component is "configured" or "programmed" denotes an existing physical condition of the component and, as such, is to be taken as a definite recitation of the structural characteristics of the component.

Having described the subject matter of the present disclosure in detail and by reference to specific embodiments thereof, it is noted that the various details disclosed herein should not be taken to imply that these details relate to elements that are essential components of the various embodiments described herein, even in cases where a particular element is illustrated in each of the drawings that accompany the present description. Further, it will be apparent that modifications and variations are possible without departing from the scope of the present disclosure, including, but not limited to, embodiments defined in the appended claims. More specifically, although some aspects of the present disclosure are identified herein as preferred or particularly advantageous, it is contemplated that the present disclosure is not necessarily limited to these aspects.

It is noted that one or more of the following claims utilize the term "wherein" as a transitional phrase. For the purposes of defining the present invention, it is noted that this term is introduced in the claims as an open-ended transitional phrase that is used to introduce a recitation of a series of characteristics of the structure and should be interpreted in like manner as the more commonly used open-ended preamble term "comprising."

What is claimed is:

1. A system for determining the productivity indices for individual laterals of a completed multilateral well under commingled flow, the system comprising a productivity index generator, a plurality of zonal inflow control valves (ICVs), and a pressure downhole monitoring system (PDHMS), wherein:

the completed multilateral well comprises a mother bore and a plurality of laterals extending from the mother bore in corresponding well zones of the mother bore;

each zonal ICV respectively controls commingled flow of an individual lateral of the plurality of laterals of the completed multilateral well;

each of the zonal ICV is configured to close for a shut-in period and open for an open period;

the PDHMS is configured to generate real time pressure measurements for each well zone of the mother bore during the respective shut-in and open periods established by the zonal ICVs; and the productivity index generator is communicatively coupled to the zonal ICVs and the PDHMS and is operable to conduct well testing of the individual laterals under non-commingled flow using the PDHMS to generate the real time pressure measurements for each well zone during the respective shut-in and open period for each individual lateral as controlled by the respective zonal ICV, determine a productivity index $P_{LN}$ for each individual lateral under non-commingled flow based on the real time pressure measurements from the well testing using the zonal ICVs and PDHMS, determine a productivity index ratio C of at least two individual laterals under non-commingled flow from the generated productivity indices $P_{LN}$, determine a global productivity index $P_G$ of the completed multilateral well under commingled flow based on the well testing using the zonal ICVs and PDHMS, determine a productivity index $P_{LC}$ for at least two of the individual laterals under commingled flow based on (i) the productivity index ratio C of at least two individual laterals under non-commingled flow and (ii) the global productivity index $P_G$ of the completed multilateral well under commingled flow.

2. The system of claim 1, wherein the productivity index generator is further operable to control the zonal ICVs to modify a flow of individual laterals based on the productivity index $P_{LC}$ for at the least two of the individual laterals to optimize production.

3. The system of claim 1, wherein the productivity index generator is further operable to generate an inflow performance relationship (IPR) plot per individual lateral based on the productivity index $P_{LC}$ for each individual lateral to identify respective production contribution at a reservoir drawdown pressure.

4. The system of claim 1, wherein the productivity index generator is further operable to determine a liquid production rate for the at least two of the individual laterals under commingled flow based on the productivity index $P_{LC}$ and a reservoir drawdown pressure;

compare the liquid production rate to a measured total liquid production rate at the reservoir drawdown pressure; and generate an alert indicative of an unacceptable error when the liquid production rate is over 5% of the measured total liquid production rate.

5. The system of claim 1, wherein to conduct the well testing of the individual laterals under non-commingled flow the productivity index generator is further operable to close a valve on a producer of the completed multilateral well such that the valve closure acts to shut-in the producer and permit pressure build-up in the completed multilateral well;

flow fluid through the mother bore separately under a limited reservoir pressure drawdown;

adjust a surface choke at a surface of the completed multilateral well to achieve a determined reservoir pressure drawdown based on the limited reservoir pressure drawdown and the real time pressure measurements by the PDHMS; and close the respective zonal ICV for each individual lateral to permit pressure build-up in each individual lateral.

6. The system of claim 5, wherein to determine the global productivity index $P_G$ the productivity index generator is further operable to open the respective zonal ICV for each individual lateral;

monitor production at the surface of the completed multilateral well under the limited reservoir pressure drawdown; and close the surface choke of the completed multilateral well at the surface to permit pressure build-up.

7. The system of claim 1, wherein the productivity index generator is further operable to determine a productivity index $P_{LC1}$ for a first individual lateral of the at least two of the individual laterals under commingled flow as a function of the productivity index ratio C, a correlation factor β, and the global productivity index $P_G$.

8. The system of claim 7, wherein the function comprises:

$$P_{LC1}=((\beta*P_G)*C)/(C+1),$$

wherein a productivity index $P_{LN1}$ of the first individual lateral under non-commingled flow divided by a productivity index $P_{LN2}$ of a second individual lateral of the at least two of the individual laterals under non-commingled flow is equal to the productivity index ratio C, and the productivity index $P_{LC1}$ divided by a productivity index $P_{LC2}$ for the second individual lateral under commingled flow is assumed to equal the productivity index ratio C.

9. The system of claim 8, wherein the productivity index generator is further operable to determine the productivity index $P_{LC2}$ for the second individual lateral under commingled flow as:

$$P_{LC2}=(\beta*P_G)-P_{LC1}.$$

10. The system of claim 1, wherein the productivity index generator is further operable to calculate liquid production rates Q for the at least two of the individual laterals under commingled flow as a function of a reservoir pressure drawdown ΔP measured during the commingled flow and the productivity index $P_{LC}$.

11. The system of claim 10, wherein the productivity index generator is further operable to determine the liquid production rates Q for each of the individual laterals as:

$$Q=\Delta P*P_{LC}.$$

12. The system of claim 11, wherein the productivity index generator is further operable to control the respective zonal ICVs to modify productivity at lateral levels based on the productivity index $P_{LC}$ to determine a global total liquid production rate $Q_t$.

13. The system of claim 12, wherein the global total liquid production rate $Q_t$ comprises a summation of the liquid production rates Q.

14. The system of claim 1, wherein the productivity index generator is further operable to control the zonal ICVs to modify the flow of the individual laterals based on the productivity index $P_{LC}$ for the at least two of the individual laterals to optimize production.

15. A system for determining the productivity indices for individual laterals of a completed multilateral well under commingled flow, the system comprising a control station, a plurality of zonal inflow control valves (ICVs), and a pressure downhole monitoring system (PDHMS), wherein:

the completed multilateral well comprises a mother bore and a plurality of laterals extending from the mother bore in corresponding well zones of the mother bore;

each zonal ICV respectively controls commingled flow of an individual lateral of the plurality of laterals of the completed multilateral well;

each zonal ICV is configured to close the flow for a shut-in period and open for an open period;

the PDHMS is configured to generate real time pressure measurements for each well zone of the mother bore during the respective shut-in and open periods established by the zonal ICVs; and the control station comprises a productivity index generator that is communicatively coupled to the zonal ICVs and the PDHMS and is operable to conduct well testing of the individual laterals under non-commingled flow using the PDHMS to generate the real time pressure measurements for each well zone during the respective shut-in and open period for each individual lateral as controlled by the respective zonal ICV, determine a productivity index $P_{LN}$ for each individual lateral under non-commingled flow based on the real time pressure measurements from the well testing using the zonal ICVs and PDHMS, determine a productivity index ratio C of at least two individual laterals under non-commingled flow from the generated productivity indices $P_{LN}$, determine a global productivity index $P_G$ of the completed multilateral well under commingled flow based on the well testing using the zonal ICVs and PDHMS, and determine a productivity index $P_{LC}$ for at least two of the individual laterals under commingled flow based on (i) the productivity index ratio C of at least two individual laterals under non-commingled flow and (ii) the global productivity index $P_G$ of the completed multilateral well under commingled flow, and the control station is further operable to control the zonal ICVs to modify the flow of the individual laterals based on the productivity index $P_{LC}$ for the at least two of the individual laterals to optimize production.

16. The system of claim 15, wherein the productivity index generator is further operable to determine a liquid production rate for the at least two of the individual laterals under commingled flow based on the productivity index $P_{LC}$ and a reservoir drawdown pressure, compare the liquid production rate to a measured total liquid production rate at the reservoir drawdown pressure, and generate an alert indicative of an unacceptable error when the liquid production rate is over 5% of the measured total liquid production rate.

17. A method for determining the productivity indices for individual laterals of a completed multilateral well under commingled flow, the completed multilateral well comprising a mother bore and a plurality of laterals extending from the mother bore in corresponding well zones of the mother bore, the method comprising, conducting well testing of individual laterals of the plurality of laterals of the completed multilateral well under non-commingled flow using a pressure downhole monitoring system (PDHMS) to generate real time pressure measurements for each well zone during respective shut-in and open periods for each individual lateral as controlled by respective zonal inflow control valves (ICVs), wherein each zonal ICV respectively controls commingled flow of an individual lateral of the plurality of laterals of the completed multilateral well;

determining a productivity index $P_{LN}$ for each individual lateral under non-commingled flow based on the real time pressure measurements from the well testing using the zonal ICVs and PDHMS;

determining a productivity index ratio C of at least two individual laterals under non-commingled flow from the generated productivity indices $P_{LN}$;

determining a global productivity index $P_G$ of the completed multilateral well under commingled flow based on the well testing using the zonal ICVs and PDHMS; and determining a productivity index $P_{LC}$ for at least two of the individual laterals under commingled flow based on (i) the productivity index ratio C of at least two individual laterals under non-commingled flow and (ii) the global productivity index $P_G$ of the completed multilateral well under commingled flow.

18. The method of claim 17, further comprising controlling the zonal ICVs to modify the flow of the individual laterals based on the productivity index $P_{LC}$ for the at least two of the individual laterals to optimize production.

19. The method of claim 17, wherein conducting the well testing of the individual laterals under non-commingled flow further comprises:

closing a valve on a producer of the completed multilateral well such that the valve closure acts to shut-in the producer and permit pressure build-up in the completed multilateral well;

flowing fluid through the mother bore separately under a limited reservoir pressure drawdown;

adjusting a surface choke at a surface of the completed multilateral well to achieve a determined reservoir pressure drawdown based on the limited reservoir pressure drawdown and the real time pressure measurements by the PDHMS; and closing the respective zonal ICV for each individual lateral to permit pressure build-up in each individual lateral.

20. The method of claim 19, wherein determining the global productivity index $P_G$ further comprises:

opening the respective zonal ICV for each individual lateral;

monitoring production at the surface of the completed multilateral well under the limited reservoir pressure drawdown; and closing the surface choke of the completed multilateral well at the surface to permit pressure build-up.

* * * * *